US005138758A

United States Patent [19]

Gubbiotti et al.

[11] Patent Number: 5,138,758

[45] Date of Patent: Aug. 18, 1992

[54] METHOD FOR JOINING TWO OR SEVERAL OVERLAYING SHEET FORMED MEMBERS TOGETHER, METAL OR NON-METAL, AND APPARATUS FOR CARRYING OUT THE METHOD

[76] Inventors: Luciano Gubbiotti, Tir-Federal 16, Ecublens, Switzerland, CH-1024; Philippe P. Rapillard, CH.DeGrange-Canal 6, Geneva, Switzerland, CH-1208

[21] Appl. No.: 707,209

[22] PCT Filed: Feb. 2, 1989

[86] PCT No.: PCT/SE89/00037

§ 371 Date: Sep. 27, 1989

§ 102(e) Date: Sep. 27, 1989

[87] PCT Pub. No.: WO89/07020

PCT Pub. Date: Aug. 10, 1989

Related U.S. Application Data

[63] Continuation of Ser. No. 411,522, Sep. 27, 1989, abandoned.

[30] Foreign Application Priority Data

Feb. 5, 1988 [CH] Switzerland ..... 8800407

[51] Int. Cl.[5] ..... B23P 11/00; B23D 39/00

[52] U.S. Cl. ..... 29/432.2; 29/509; 29/243.5; 29/283.5; 29/521

[58] Field of Search ..... 29/243.5, 283.5, 509, 29/432.1, 432.2, 521, 522.1, 525; 72/356, 465

[56] References Cited

U.S. PATENT DOCUMENTS

| | | | |
|---|---|---|---|
| Re. 31,135 | 3/1984 | Schleicher | 29/432.2 |
| 3,914,845 | 10/1975 | Olsson | 29/243.5 |
| 3,924,378 | 12/1975 | Hafner | 52/758 D |
| 3,981,064 | 9/1976 | Hafner | 29/432 |
| 4,035,901 | 7/1977 | Lux et al. | 29/243.5 |
| 4,184,396 | 1/1980 | Hafner | 83/623 |
| 4,208,776 | 6/1980 | Schleicher | 29/243.5 |
| 4,459,735 | 7/1984 | Sawdon | 29/509 |
| 4,531,279 | 8/1986 | Gunter | 29/509 |
| 4,569,111 | 2/1986 | Mutou | 29/283.5 |
| 4,601,090 | 7/1986 | Gunter | 29/243.5 |
| 4,607,418 | 8/1986 | Hafner | 29/21.1 |
| 4,709,458 | 12/1987 | Peters | 29/21.1 |
| 4,803,767 | 2/1989 | Obrecht et al. | 29/243.5 |
| 4,831,711 | 5/1989 | Rapp | 29/509 |
| 4,897,912 | 2/1990 | Slasinski | 29/521 X |

FOREIGN PATENT DOCUMENTS

| | | |
|---|---|---|
| 2852909 | 6/1980 | Fed. Rep. of Germany . |
| 3210208 | 9/1983 | Fed. Rep. of Germany . |
| 3210956 | 9/1983 | Fed. Rep. of Germany . |
| 2056005 | 5/1971 | France . |
| 2337599 | 1/1976 | France . |
| 314048 | 9/1968 | Sweden . |
| 382163 | 1/1976 | Sweden . |
| 1603231 | 11/1981 | United Kingdom . |

*Primary Examiner*—Joseph M. Gorski
*Assistant Examiner*—S. Thomas Hughes
*Attorney, Agent, or Firm*—Eric Y. Munson; Mark P. Stone

[57] ABSTRACT

The present invention provides method and apparatus for joining together two or more overlaying sheet formed metals, either metallic or non-metallic, in which a movable punch is moved towards a stationary die axially in a first direction and into a first position that is independent of the thickness or the number of sheet formed members to be joined together. Thereafter, an anvil is co-axially moved towards the die and into a second relative position that is also independent of the thickness or the number of sheet formed members to be joined together. The anvil is blocked in its second relative position by a blocking element, and a movable die is co-axially moved towards the anvil and into a third relative position that is dependent upon forces applied to the die and on the number, thickness and material of the sheet formed members to be joined together. As an alternative, the punch may be the stationary element, while the die is the movable element. In either case, the first predetermined relative position between the punch and the die at the end of the first stroke is independent of both the thickness and number of sheet formed members to be joined together.

12 Claims, 5 Drawing Sheets

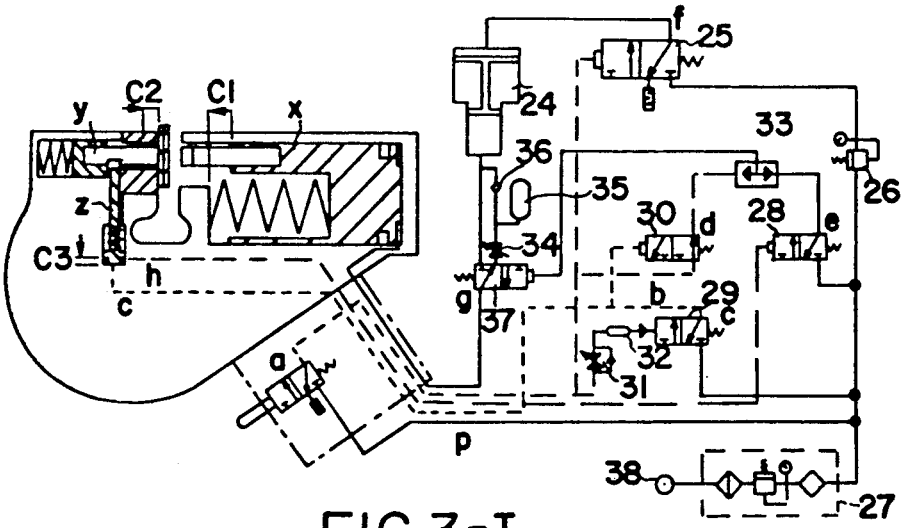
FIG.3-I
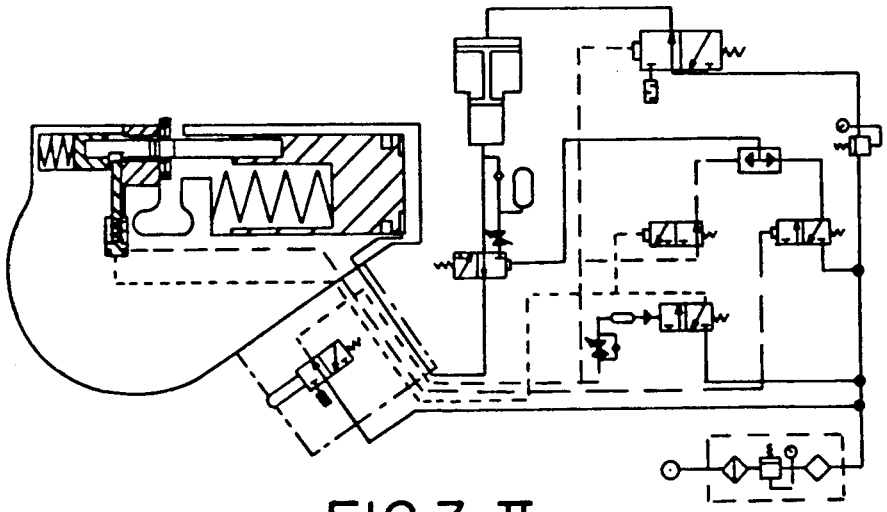
FIG.3-II
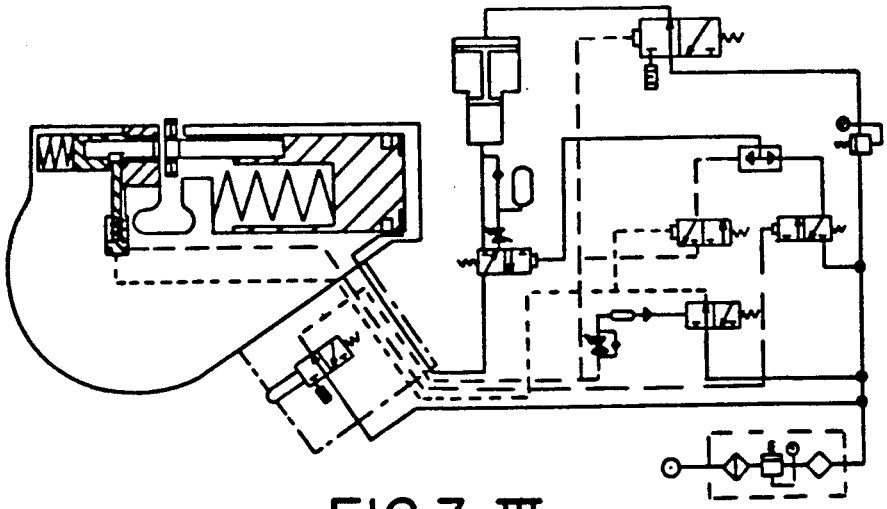
FIG.3-III

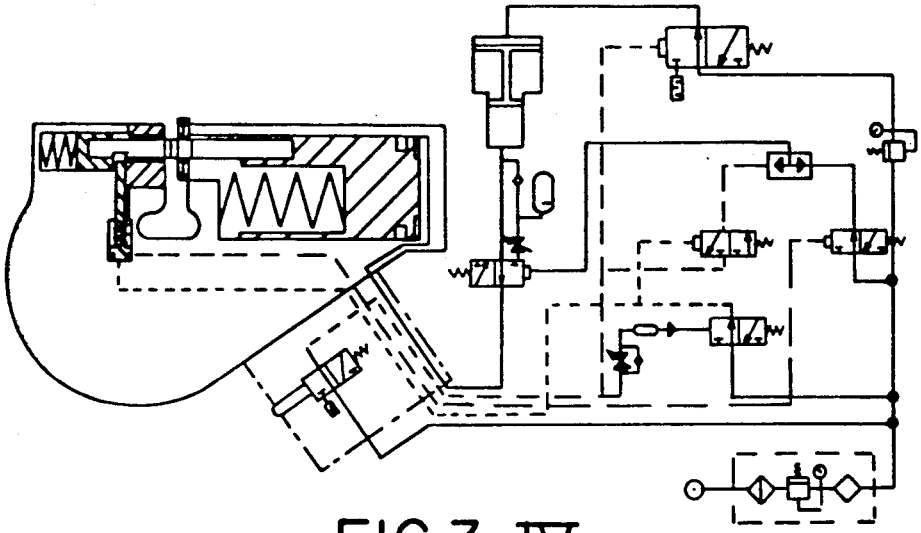
FIG. 3-IV
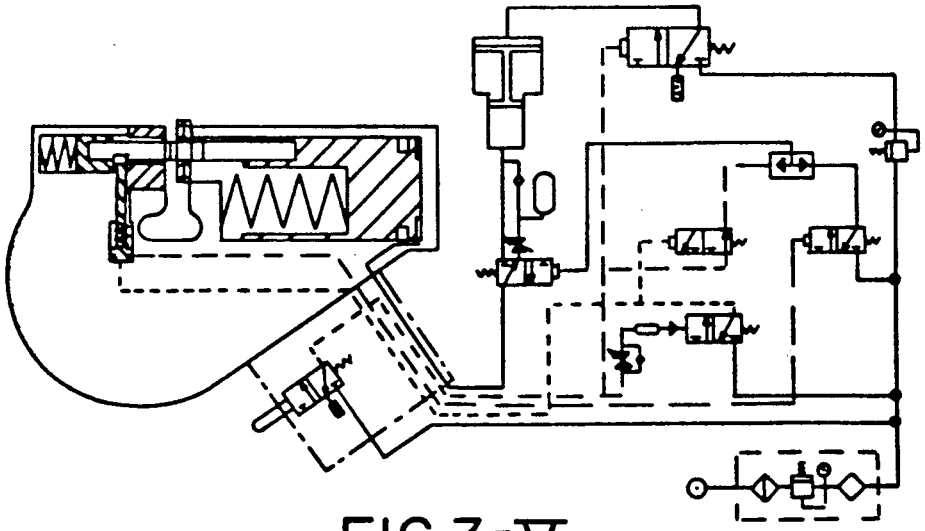
FIG. 3-V

METHOD FOR JOINING TWO OR SEVERAL OVERLAYING SHEET FORMED MEMBERS TOGETHER, METAL OR NON-METAL, AND APPARATUS FOR CARRYING OUT THE METHOD

This application is a continuation of application Ser. No. 07/411,522, filed Sep. 27, 1989, abandoned.

TECHNICAL FIELD

This invention relates to methods for joining two or more metallic or non-metallic overlaying sheet formed members together, and apparatus for carring out such methods.

BACKGROUND ART

It is well known that a pair of overlaying metal members could be joined together by lancing and forming a part of one member through an unblanked part of the other member, and thereafter staking the lanced and formed part of the one member to an adjacent surface of the other member to secure the members together in overlaying relation.

For example, U.S. Pat. No. 3,924,378 shows such a joining operation carried out by means of an apparatus having two separately actuatable rams, one of the rams carrying a lancing and forming die and the other ram carrying a flattening punch or anvil, whereby the one ram performs the lancing and forming operation and the other ram performs the staking operation. The apparatus is provided with adjustment means so that the upper sheet (or sheets) of the displaced section is (are) not engaged by the downwardly moving flattening punch until the lowermost sheet of the displaced section is uncovered by the upwardly moving die, so as to allow the lower sheet of the displaced section to be spread while the upper sheet or sheets are still confined by the die. Thus, said adjustment means must be operated for different thickness of the sheets.

U.S. Pat. No. 4,035,901 shows an apparatus having a single reciprocating head provided with a first means, i.e., a die, to perform the lancing and forming step on a first stroke of the head, and provided with a second means, i.e., an anvil, that performs the staking operation on the second stroke of the same head. When the thickness of one or several of the sheets to be joined together or the material of the sheets is changed, the stroke length of the first and the second strokes must be adjusted.

GB-A-1 603 231 shows another machine for making a joint of the above-mentioned type. In this machine, the moving head comprises the punch which in a first stroke pierces the sheets against the die placed underneath said sheets. Before the second stroke, the die as well as the anvil are axially repositioned by holding means having inclined plane surfaces. If the thickness of the sheets is changed, the reposition movement must be adjusted.

The above examples of prior art all disclose systems having a relatively simple one-piece, non-expansible die. The corresponding machines are, in principle, of the two-stroke type. The second stroke is carried out with the deformed sections of the sheets at least partly outside the die.

However, other systems and apparatus, operating with only one stroke are known in which the die is laterally expansible. In this type of apparatuses the second part of the joint-forming-process takes place inside the die. U.S. Pat. No. 4,459,735 discloses an apparatus and a method of this type. By necessity, the design of the die is much more complicated in a system like this, and the choice of material for the die might be critical. Thus the life expectancy for such a die is comparatively low, which makes the maintenance costs high for the tool. In addition, one and the same die cannot be used if the thickness of the sheets is changed.

DISCLOSURE OF THE INVENTION

One object of the present invention is to provide a method for joining together two or more overlaying sheet-formed members in a two-stroke process to produce a first type of joint with a single set of die, punch and anvil, and without adjustment of said units for different sheet thickness, number or material.

Another object of the invention is to provide an apparatus for carrying out said method, capable of producing at least two different types of joints, e.g. leak proof and non-leak proof joints, using different sets of die, punch and anvil.

Due to the fact that the mechanical forces needed to make the joint according to the inventive method are comparatively low, it is also possible to design the apparatus to be very light and compact for use as a versatile hand-held tool.

A further advantage of the invention is that the life expectancies for the tool units punch, die and anvil, especially the critical die, are high. This is due to the relatively rugged design of the die compared to known designs.

Our invention, which provides a solution to the said technical problems, is characterised according to the appended claims.

BRIEF DESCRIPTION OF THE FIGURES

Other objects, uses and advantages of this invention are apparent from the reading of this description which proceeds with reference to the accompanying drawings forming part thereof and wherein:

FIGS. 3I-3V show the essential phases of a complete operation cycle.

DETAILED DESCRIPTION OF THE INVENTION

Figure 1:
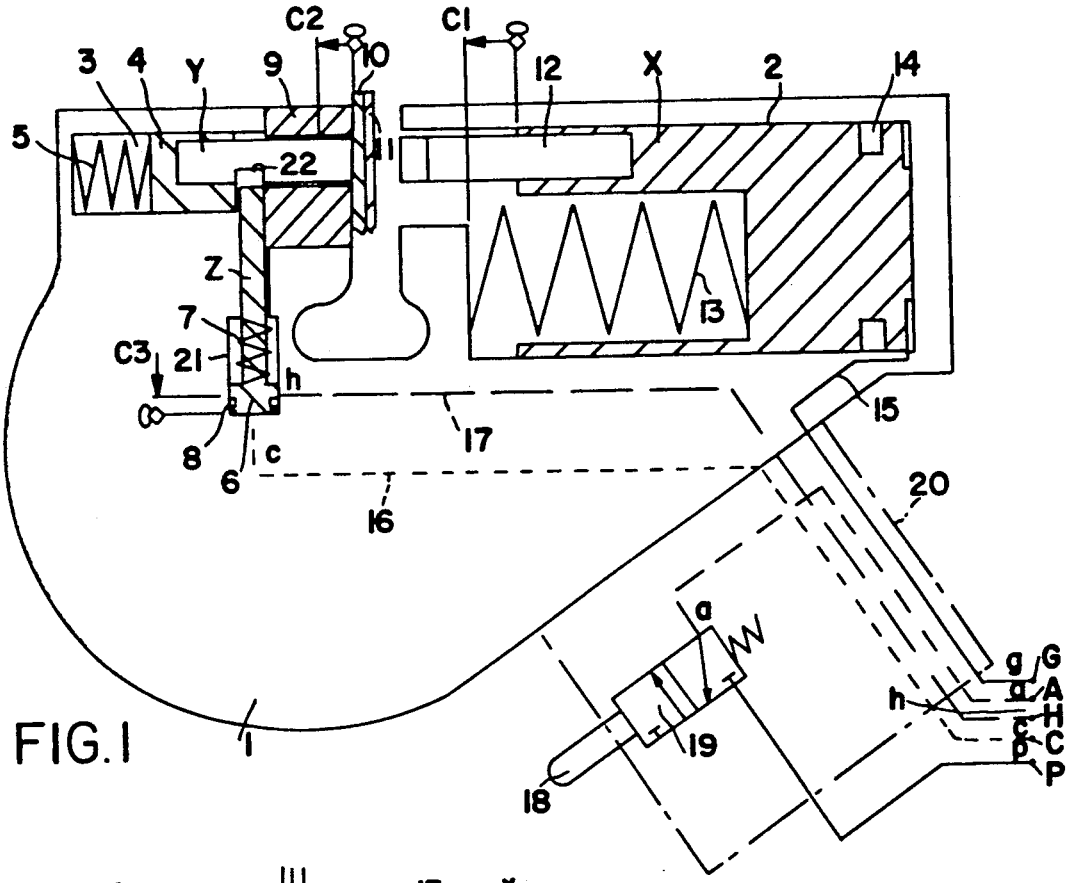
FIG. 1 shows an apparatus according to the present invention implemented as a hand held tool.

FIG. 1 shows an apparatus according to the present invention. The embodiment refers to a hard-held tool, but the principles of the method and the apparatus are applicable to stationary equipment as well.

The main parts of the machine are the body 1 with the handle 20. The body is provided with three moving systems. The first of those systems constitutes a single-acting cylinder-piston assembly with a piston X in the cylinder 2, and a spring 13. The piston is mechanically coupled to a punch 12 which is moved by the piston. The second moving system comprises a movable anvil Y, a spring guiding member 4, and a spring 5. The member 4 transfers the forces from said spring 5 to the anvil Y. All of the said parts are contained in the cavity 3. The anvil Y is coaxially movable with the punch 12. In one direction, i.e. to the right in FIG. 1, the anvil is moved by means of forces from the spring 5 transfered through the member 4, and in the other direction it is moved by means of forces from the punch 12. In this particular embodiment, the anvil Y is guided by a die 9 which cooperates with the punch 12. The third moving system is also a single-acting cylinder-piston combination 6,8,7,21. The piston 6 is mechanically coupled to the blocking member Z which acts on the anvil Y.

In order to operate the three different moving systems, hydraulic and/or pneumatic pressure signals are connected to the systems by means of conduits or channels 15,16,17 within the body 1. A handle 20, schematically shown in FIG. 1, is fixed to the body 1. The handle is provided with a manual valve 19 which in this case is a three way/two position/normally closed valve having a trigger 18. The fluid input/output ports of the tool are marked G, A, H, C, P, and the corresponding fluid signals are designated g, a, h, c, p.

For the operation of the tool, the input/output ports have to be connected to a control unit which could be designed sequence of signals to the different ports during the operation cycle.

Figures 2A, 2B:
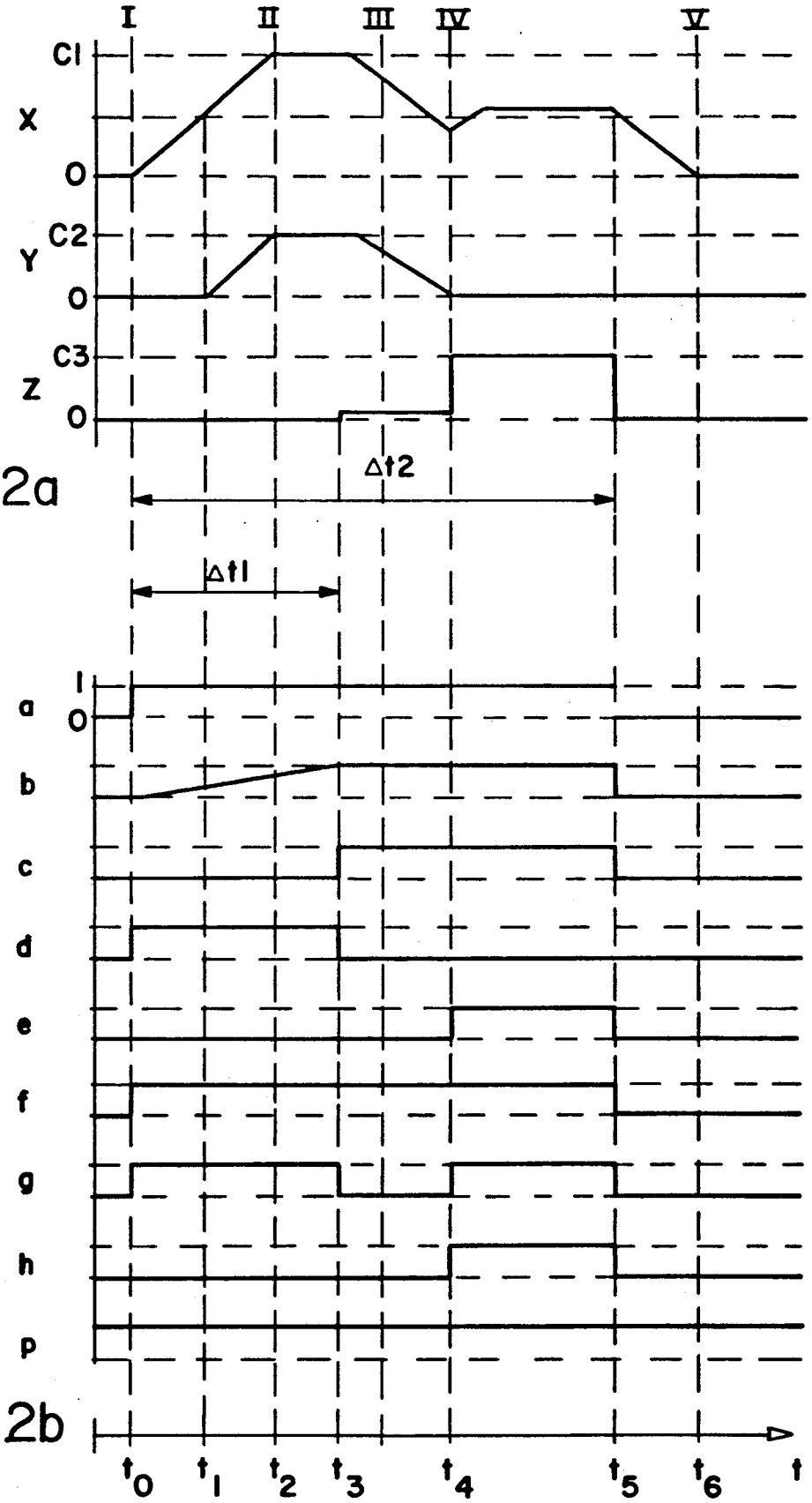
FIG. 2*a* is a diagram showing on a time scale the motion of three essential parts of the machine.
FIG. 2*b* is a signal diagram showing the input and output signals to and from the apparatus according to FIG. 1 as well as certain internal signals of the connected control unit.

FIG. 2*b* shows a signal diagram for the input/output signals at the respective ports during one complete operation cycle, and FIG. 2*a* shows the resulting movements of the three moving systems of the tool. In this part of the description, only signals g, a, h, c, p are considered. The other signals illustrated in FIG. 2*b* are internal signals of the control unit which will be described later on. The signals now considered have all been illustrated as binary signals in which the transfer between the two signal levels takes place without any time delay. In reality this is of course not the case, but for the sake of simplicity, the hydraulic/pneumatic signal time delay is not considered here. On the other hand, the time delays in the physical movements of the three systems are much larger and have to be taken into account. These time delays are therefore shown in FIG. 2*a*. Although the movement between different positions of the systems are not linear in time, they have, for the sake of simplicity, been so illustrated in FIG. 2*a*.

As mentioned above, a certain sequence of signals must be provided at the input/output ports to make the tool work. Many different embodiments of control units capable of delivering such a sequence could be envisioned, a few examples of which will be described below.

At first, a general description of the operation of the tool will follow without any reference to details of a specific control unit.

The following description refers to FIGS. 1 and 2. Up to time t0, the tool is in its rest position having its control unit connected to the power source, i.e. in this case pneumatic pressure, ready to operate. The input port P is, during the whole cycle, provided with pneumatic pressure which can be seen from FIG. 2*b*. In the following description it is assumed that two sheets 10, 11, which are to be joined together, are positioned between the punch 12 and the die 9.

At time t0, the trigger 18 is operated which causes the pressure from input P to be connected through the valve 19 to output A. As a response to this pressure rise at output A, the control unit deliveres a high pressure hydraulic signal g to input port G and the first moving system. As mentioned above, the minor time delays between the occurence of these signals are not considered here. The oil, which now enters the cylinder 2 of the first moving system, causes the piston X to start its movement to the left in FIG. 1. The punch 12, moving with the piston X, will make contact with the sheet 11 at time t1. When making a first type of joint, the punch 12 at the corresponding position will start to cut the two sheets, and the anvil Y of the second moving system will be moved to the left in FIG. 1 against the force of the spring 5. This movement continues until the piston X reaches the position c1 at time t2 illustrated in FIGS. 1 and 2. At this position, the punch has just cut through the two sheets 11 and 10 along part of the punch circumference. The length of the piston stroke is defined by the design of the first moving system. With an appropriate length of the punch 12 the corresponding position of the punch tip could, e.g., be made flush with the common surface between the sheet 10 and the die 9. As can be seen from FIG. 2*a*, the anvil has now reached the position c2.

In the next step, at time t3, the control unit delivers a signal c on the input C with a set time delay Δ t1 measured from the operation of the trigger. In the present embodiment, this signal is a pneumatic signal. The signal acts on the third moving system of the tool and actuates the piston 6 which forces the blocking member Z against the anvil Y without engaging the blocking slot 22. At the same time, the hydraulic pressure to the first moving system drops, as can be seen from FIG. 2*b*. This means that the piston X of the first moving system will start moving to the right in the FIG. 1, forced by the two springs 13,5. The anvil Y and the two sheets 10,11, still in contact with the punch 12, will follow the movement to the right in FIG. 1.

The third moving system is still under pressure, and at time t4, the blocking slot 22 is just opposite to the blocking member Z. Thus, the anvil will be blocked in the corresponding position when the piston 6 moves forward. The third moving system could consequently also be considered as a position indicator for the anvil. When moving forward, the piston 6 opens a conduit or channel for the pressure signal h which is an output signal from the tool to the control unit indicating that the anvil has reached a defined position and is now blocked. The control unit responds by once again delivering hydraulic pressure on input G of the tool. The direction of the movement of the first moving system is reversed, and the punch 12 carries out a second stroke. As mentioned above, the anvil is now blocked in position c3, as shown in FIG. 2*a*.

The deformed portions of the two sheets 10 and 11 are now outside, or at least partly outside, the die 9. Mechanical forces between the punch 12 and the anvil Y will now squeeze the deformed portions of the two sheets and make these portions expand laterally. As long as the operator holds the trigger, nothing more will happen in the tool after the punch 12 has reached its final position, which position is dependent on the pressure of the signal g and the thickness and material of the sheets to be joined. The pressure will be set manually on the control unit to an appropriate value as described below.

At time t5, which in this particular embodiment is defined as the moment when the trigger is released, all the signals except p return to zero and the tool returns to its rest position. The time interval between t0 and t5 is defined as Δ t2 in FIG. 2. This time interval could, of course, alternatively be set internally in the control unit. At time t5, thus, the piston of the first moving system will once again reverse its direction of movement. At the same time, the blocking member Z will release the anvil. As can be seen from FIG. 1, the blocking member is still blocking the spring guiding member 4 so that the anvil cannot move further to the right. Due to the mechanical deformations of the sheets around the punch, they will follow the punch in its movement to the right until they reach the edge of the cylinder housing in the tool gap. At this point, they will be disengaged from the punch 12 which continues its motion to the right to the rest position. In the diagram *2b*, this moment corresponds to time t6.

FIG. 3(I-V) shows the essential phases of a complete operation cycle. The tool as illustrated is the same as just described, and the connected control unit is an example of such a unit capable of delivering the signals of FIG. *2b*. The designations of the five FIGS. (I-V) correspond to the same designations in FIG. 2.

FIG. 3(I) shows the status of the control unit when the input 38 is provided with pneumatic pressure from a standard source available in the workshop. The unit 27 is a standard air preparation unit including a filter, a regulator and a lubricator. This part of the control unit is not essential for the description of the operation of the circuit. It forms, however, part of a practical realization of said circuit. As can be seen, the input P of the tool is provided with the regulated pressure already at this stage. The inputs to the valves 29, 28, 25, all of the 3 way/2 position, normally closed, pressure controlled type, are also provided with regulated pressure. At the input of the valve 25, a second regulator 26 is arranged to set the pressure to the pneumatic-hydraulic booster 24 and thus the output hydraulic pressure to the input G of the tool in its turn, operates the first moving system of the tool. This state corresponds to the time before t0 in FIG. 2.

As described above, at time t0 the trigger was operated which caused an operating signal a to be transfered to the control unit, as shown in FIG. 3 (II). When this signal is received by the control unit, the following will happen. The valve 25 will open, and the regulated pressure from its input will be communicated to the input of the booster 24. The signal a will also be conducted through the valve 30, which is of the 3 way/2 position, normally open, pressure controlled type, to the pneumatic OR-gate 33 and open the hydraulic, 3 way/2 position, normally closed valve 37. As a result, the amplified hydraulic pressure at the output side of the booster 24 will be conducted through said valve to the input G of the tool. At the same time, the pneumatic delay circuit 31, 32 will be activated which starts the time delay t1, as shown in FIG. 2.

Assuming that the trigger is still operated, the next change in the signal state at the output of the control unit will be decided by the time delay Δ t1. The output signal b from the delay circuit is shown in FIG. *2b*. At time t3, i.e at the end of said time delay, the high level of this signal is reached and the valve 29 will be opened delivering the pneumatic output signal c from the control unit as shown in FIG. 3 (III). At the same time, the valve 30 will be closed and the signal d returns to zero. Consequently, the hydraulic valve 37 will also be closed. A leakage path is opened for the return pressure from the first moving system through the valve 37, the hydraulic restriction 34 and to the hydraulic accumulator 35. The booster 24 still delivers the amplified pressure on its output which is, however, now blocked by the valve 37. The leakage pressure from the first moving system back to the control unit is much lower, which means that the check-valve 36 is closed. By means of the restriction 34, it is possible to adjust the reverse speed of the piston X of the first moving system.

When the signal h raises, at time t4 as described above, indicating the blocking of the anvil Y, the valve 28 will be opened, as shown in FIG. 3 (IV). The regulated input pressure will thus be transferred through the OR-gate 33 to the valve 37 and open this valve, once again giving the hydraulic output pressure g which will start the second stroke of the first moving system of the tool.

Finally, when the operator releases the trigger at time t5, as shown in FIG. 3 (V), the signal a will return to zero, and the remaining pressure from the pressure accumulator 32 of the delay circuit will leak through the check valve parallel to the flow restriction 31 and back to the trigger valve of the tool where it is exhausted. This means that the signal b returns to zero, and the valve 29 will be closed. When closed, it brings signal c to zero which, in turn, closes valve 30 and causes the blocking member to return to its rest position. At this rest position the signal h will return to zero, closing the valve 28 and causing the hydraulic valve 37 to close.

When the valve 37 closes, the leakage path for the first moving system through that valve is opened once again. Due to the fact that the signal f has dropped to zero, the piston of the booster is now free to move upwards. When the pressure at the output of the booster has dropped to the same level as the pressure in the hydraulic accumulator 35, the check-valve 36 will open and connect a return oil flow from the accumulator and the first moving system of the tool back to the booster 24.

Thus the final rest status is reached with all signals, except the signal p, at zero level, and the operation cycle is completed.

Figure 4:
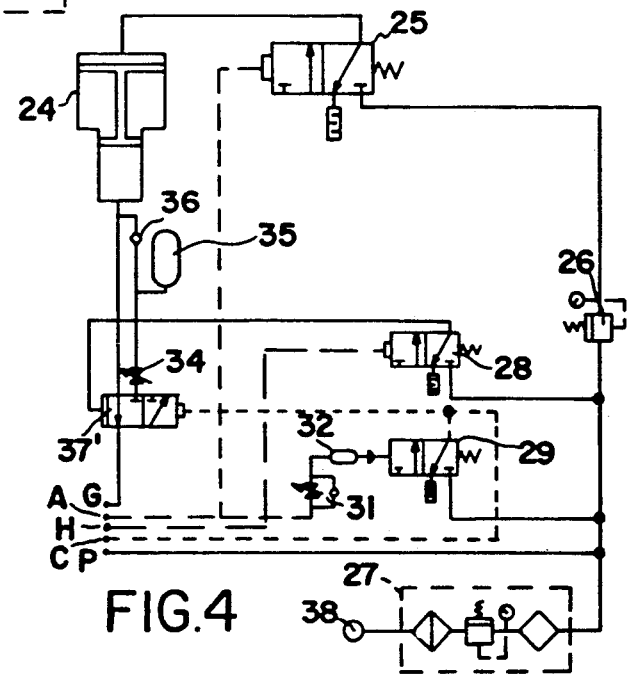
FIG. 4 shows a second embodiment of the control unit.

FIG. 4 shows a second embodiment of the control unit. The designations of corresponding components are the same. The main difference from what has been described above resides in the design of the hydraulic valve 37 here called 37'. In this embodiment, this valve is controlled by means of pneumatic pressure in both directions. When using such a valve, it is possible to dispose of the pneumatic OR-gate 33 and the valve 30, shown in the first embodiment. Therefore a control unit according to FIG. 4 is cheaper. The two embodiments now described both operate with high pressure at the output from the booster during the whole operation cycle of the tool.

Figure 6:
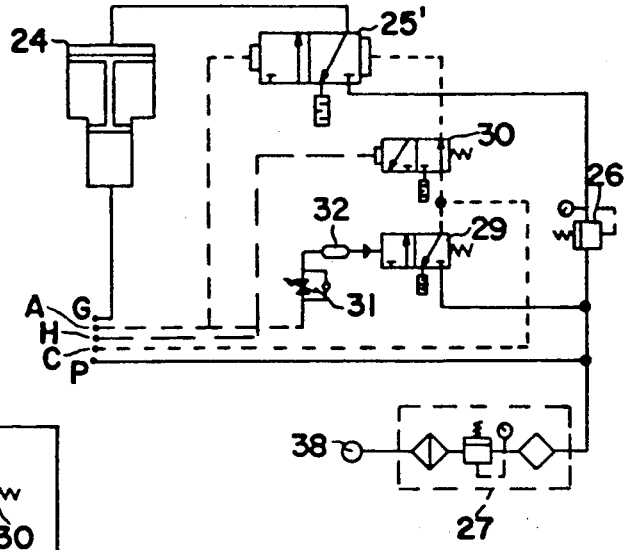
FIG. 6 shows a fourth embodiment of the control unit.
Figure 5:
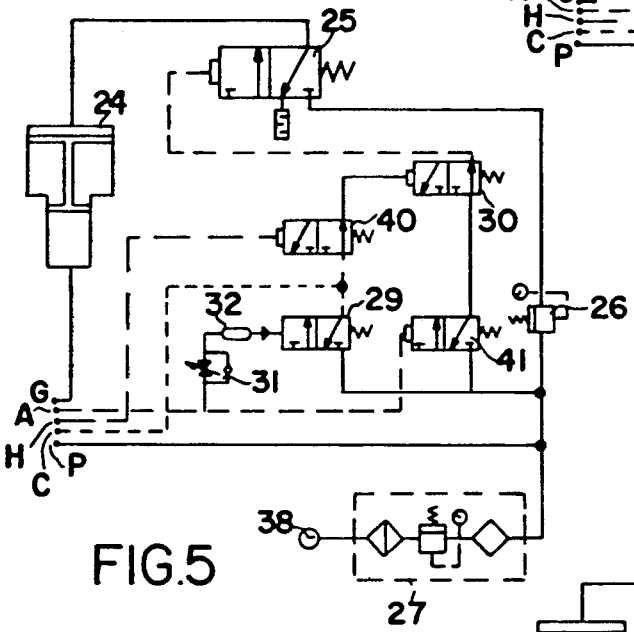
FIG. 5 shows a third embodiment of the control unit.

In FIGS. 5 and 6, two other embodiments of the control unit are shown in which the output from the booster is not provided with a hydraulic valve. This means that in order to have the first moving system of the tool making two strokes, the piston of the booster has to make two strokes. Now, the air volume, and consequently the corresponding pneumatic capacity in the booster, is considerable, which means that the stroke of the piston of the booster will be rather slow. Therefore, even if the two embodiments according to FIGS. 5 and 6 could deliver the same signals to the tool as described above, the time scale will be different.

In order to be able to adjust the speed of the backward movement of the first moving system of the tool in the FIGS. 5 and 6 embodiments, in a manner similar to that discussed with respect to the previously described embodiments, it is possible to introduce a parallel combination of a check-valve and an adjustable pneumatic restriction between the booster 24 and the valve 25 and 25', respectively.

Of course, many other configurations for the control unit could be conceived for providing the same sequence of output signals to the tool.

All of the described embodiments of the control unit, as well as the tool itself, are supplied with the necessary power from the pneumatic pressure source 38. Other types of power sources, e.g. electrical, could of course be envisioned for the tool and/or the logic. Cam driven mechanical actuators for the moving parts may also be used as a power source, particularly for stationary machines.

The components 28, 33, 30, 31, 32, 29 of the first described embodiment of the control unit could, for instance, be changed to electronic equivalents, and one of the pneumatic pressure regulators of the unit 27 and 26 respectively, could, in that case, be eliminated. In the tool, the trigger could be an electrical trigger, and the blocking unit Z, 6, 7, 8, 21, could be an electro magnetical unit generating an electrical output signal h. Such a system would provide the same input and output signals between the tool and the control unit as shown in FIG. **2*b***, although some of them would now be electrical.

A further envisioned embodiment has a hydraulic pump driven by an electrical motor instead of the pressure booster 24.

A substitution of the trigger by a pedal, or arranging the feed-back signal h to be taken out from the first moving system, are examples of changes within the general scope of this invention.

Figure 10:
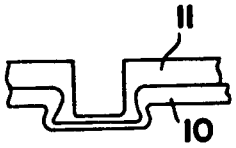
FIG. 10 shows a section through a circular joint which could be produced with an arrangement according to FIG. 1.

When describing the tool and the operation sequence of the same above, it has been assumed that the resulting joint will be of the non-leak proof type. In the first stroke, the punch 12 will cut through the two sheets 10, 11 along part of the circumference of the punch. However, other types of joints could be produced by means of the described method making use of slightly different sets of punch, die and anvil in the tool. It is here referred to a leak proof type of joint of the same general type as described in the U.S. Pat. No. 4,459,735 mentioned above in the description of the prior art, as shown in FIG. 10. As mentioned, that system operates with only one stroke of the moving part of the machine, and the die has laterally moving parts. In our system, on the other hand, the main moving unit of the tool makes two strokes. The dimensions of the cooperating punch and die are such that the punch in the first stroke does not cut through any part of the sheets, but makes a preferably cylindrical deformation by a drawing action mainly in the clearance between the punch and the die. By means of the anvil the deformed portions of the two sheets, are then brought outside the die before the second stroke takes place. The free lateral extrusion of sheet material then takes place during the second stroke.

Figure 7:
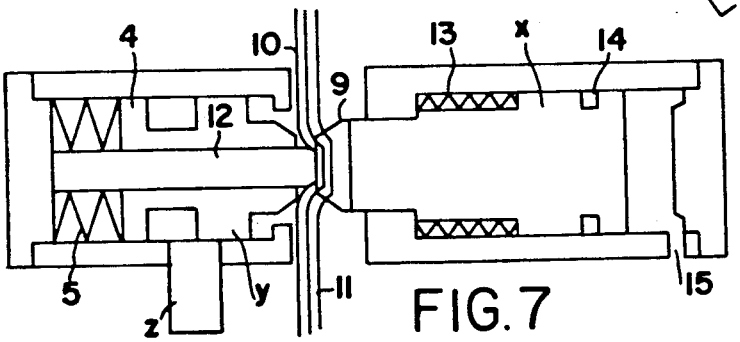
FIG. 7 shows an alternative arrangement of the punch, die and anvil according to the invention.
Figure 8:
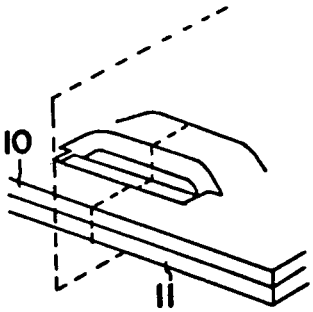
FIG. 8 shows a type of joint which could be produced by means of the arrangement according to FIG. 7.

In FIG. 7, an alternative arrangement of the moving parts is shown. The same designations have been used for corresponding units. In this embodiment, the die 9 is moved by the piston X towards the punch 12 in the first stroke. The first predetermined relative position between the die and the punch is defined by the end position of the piston movement. The anvil Y is operated in the same way as described above. A joint which could be produced by means of this arrangement is shown in FIG. 8.

Figure 9:
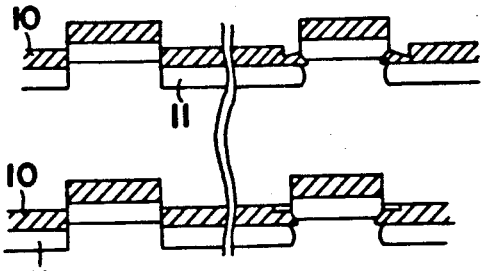
FIG. 9 shows examples of sections through joints according to FIG. 8.

Two sections through such a joint are shown in FIG. 9.

We claim:

1. A method for joining together two or more overlaying sheet formed members of a predetermined total thickness; said method utilizing cooperating relative movements of a co-axial arrangement of a punch, die, and an anvil; one of said punch and said die comprising a movable element, and the other of said punch and said die comprising a fixed element: the steps of said method comprising:

positioning said sheet formed members between said movable element and said fixed element, applying a force to said movable element for moving said movable element, without providing any prior adjustment to a distance to be travelled by said movable element, in a first movement in a first direction co-axially towards said fixed element and into a first predetermined position relative to said fixed element that is independent of the total thickness of said sheet formed members to be joined together, applying a force to said anvil for moving said anvil co-axially in a direction opposite to that of said first movement of said movable element into a second predetermined position relative to said fixed element that is independent of the total thickness of said sheet formed members to be joined together, blocking axial movement of said anvil in said second position, and joining said sheet formed members by applying a further force to said movable element for moving said movable element in a second movement in said first direction co-axially towards said anvil and into a third position for joining together by deforming said sheet formed members by forces applied thereto resulting from the movement of said movable element into said third position, said third position being dependent on said applied forces and on the number, thickness and material of said sheet formed members to be joined together.

2. The method as claimed in claim 1 wherein said movable element is said punch, and said fixed element is said die.

3. The method as claimed in claim 1 wherein said movable element is said die, and said fixed element is said punch.

4. The method according to claim 1, characterized in that in said first predetermined position, a tip of said punch is flush with a top surface of said die.

5. A method according to claim 1, characterized in that during said first movement of said movable element, a tip of said punch does not reach a plane through a top surface of said die, but stops at a predetermined distance from said plane.

6. A method according to claim 1, characterized in that during said first movement of said movable element a tip of said punch passes a plane through a top surface of said die and stops at a predetermined distance from said plane.

7. A method according to claim 1, chacterized in that in said second predetermined position, a tip of said anvil is flush with a plane through a top surface of said die.

8. A method for joining together two or more overlaying sheet formed members of a predetermined total thickness; said method utilizing cooperating relative movement of a co-axial arrangement of a punch, die, and an anvil; one of said punch and said die comprising a movable element, and the other of said punch and said die comprising a fixed element; the steps of said method comprising:

positioning said sheet formed members between said movable element and said fixed element, applying a force to said movable element for moving said element, without providing any prior adjustment to a distance to be travelled by said movable element, in a first movement in a first direction co-axial relative to said fixed element and into a first predetermined position relative to said fixed element that is independent of the total thickness of said sheet formed members to be joined together, applying a force to said anvil for moving said anvil co-axially relative to said fixed element and into a second predetermined position relative to said fixed element that is independent of the total thickness of said sheet formed members to be joined together, blocking axial movement of said anvil in said second position, and joining said sheet formed members by applying a further force to said movable element for moving said movable element in a second movement co-axial relative to said anvil and into a third position for joining together by deforiming said sheet formed members by forces applied thereto resulting from the movement of said movable element into said third position, said third position being dependent on said applied forces and on the number, thickness and material of said sheet formed members to be joined together.

9. An apparatus for joining together two or more overlaying sheet formed members of a predetermined total thickness; said apparatus including a punch, a die and an anvil; one of said punch and said die comprising a movable element, and the other of said punch and said die comprising a fixed element; said apparatus comprising:

means for moving said movable element, without providing any prior adjustment to a distance to be travelled by said movable element, in a first direction of movement co-axially towards said fixed element and into a first predetermined position relative to said fixed element that is independent of the thickness of said sheet formed members to be joined together, means for moving said anvil co-axially in a direction opposite to said first direction of movement of said movable element and into a second predetermined position relative to said fixed element that is independent of the thickness of said sheet formed members to be joined together, means for blocking axial movement of said anvil in said second position, wherein said means for moving said movable element into said first predetermined position comprises a means for providing a second movement of said movable element in said first direction co-axially towards said anvil and into a third position, said third position being dependent on applied forces and on the thickness, number, and material of said sheet formed members to be joined together.

10. The apparatus as claimed in 9 wherein said movable element is said punch, and said fixed element is said die.

11. The apparatus as claimed in claim 9 wherein said movable element is said die, and said fixed element is said punch.

12. An apparatus for joining together two or more overlaying sheet formed members of a predetermined total thickness positioned between a die and a punch; said apparatus including a punch, a die, and an anvil; one of said punch and said die comprising a movable element, and the other of said punch and said die comprising a fixed element; said apparatus comprising:

means for moving said movable element, without providing any prior adjustment to a distance to be travelled by said movable element, in a first direction of movement co-axial relative to said fixed element and into a first predetermined position relative to said fixed element that is independent of the total thickness of said sheet formed members to be joined together, means for moving said anvil co-axially relative to said fixed element and into a second predetermined position relative to said fixed element that is independent of the total thickness of said sheet formed members to be joined together, means for blocking axial movement of said anvil in said second position, wherein said means for moving said movable element into said first predetermined position comprises a means for providing a second movement of said movable element co-axial relative to said anvil and into a third position, said third position being dependent upon applied forces and on the thickness, number, and material of said sheet formed members to be joined together.

* * * * *

UNITED STATES PATENT AND TRADEMARK OFFICE

CERTIFICATE OF CORRECTION

PATENT NO. : 5,138,758

DATED : August 18, 1992

INVENTOR(S) : Luciano Gubbiotti

It is certified that error appears in the above-indentified patent and that said Letters Patent is hereby corrected as shown below:

On the title page, Item [73] Assignee's should read -- ATTEXOR EQUIPMENTS S.A. --.

Signed and Sealed this

Seventh Day of September, 1993

Bruce Lehman

*Attest:*

BRUCE LEHMAN

*Attesting Officer*

*Commissioner of Patents and Trademarks*